US006712449B2

(12) United States Patent
Smith

(10) Patent No.: US 6,712,449 B2
(45) Date of Patent: Mar. 30, 2004

(54) LIGHTFASTNESS/GAMUT MODULATION VIA SEPARATION OF COLORANT SPECIES IN INKJET PRINTERS

(75) Inventor: Gregory S. Smith, Ocean Side, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 187 days.

(21) Appl. No.: 10/000,380

(22) Filed: Oct. 31, 2001

(65) Prior Publication Data

US 2003/0103103 A1 Jun. 5, 2003

(51) Int. Cl.[7] ..... B41J 2/21; B41J 2/01
(52) U.S. Cl. ..... 347/43; 347/101
(58) Field of Search ..... 347/43, 15, 101

(56) References Cited

U.S. PATENT DOCUMENTS 5,777,641 A * 7/1998 Suzuki et al. ..... 347/15

OTHER PUBLICATIONS

U.S. Patent No. 5,851,273 dated Dec. 22, 1998 by Morris, et al. entitled "Dye Set for Improved Ink–Jet Print Quality".
U.S. Patent No. 5,772,742 dated Jun. 30, 1998 by Wang entitled "Dye Set for Improved Color Quality for Ink–Jet Printers".
U.S. Patent No. 5,851,274 dated Dec. 22, 1998 by Lin entitled "Ink Jet Ink Compositions and Processes for High Resolution and High Speed Printing".
U.S. Patent No. 6,036,298 dated Mar. 14, 2000 by Walker entitled "Monochromatic Optical Sensing System for Inkjet Printing".

* cited by examiner

*Primary Examiner*—Thinh Nguyen

(57) ABSTRACT

The present invention is directed toward a method of that provides a user with the ability to choose the combination of dye species that best fits his or her application. Users can create prints that are colorful, lightfast, or some combination of these two. In one embodiment, the invention takes into account the characteristics of the printing medium and determines from that information how to optimize the lightfastness and gamut of an image. Lightfastness and gamut tend to relate inversely, in that the better the lightfastness, the worse the gamut and vice versa. The lightfastness and gamut of an image can be altered by changing the colorants used to print the image. High-chroma inks produce images with high gamut values. Conversely, images printed with low-chroma inks have increased lightfastness. An embodiment of this invention uses the characteristics of the print medium, upon which the image will be printed, to optimize the tradeoffs that exist between lightfastness and gamut. In this embodiment the relative amount of high- and low-chroma ink varies depending upon the characteristics of the print medium.

9 Claims, 3 Drawing Sheets

LIGHTFASTNESS/GAMUT MODULATION VIA SEPARATION OF COLORANT SPECIES IN INKJET PRINTERS

FIELD OF THE INVENTION

This invention relates to a method that provides a user with the ability to choose the combination of dye species that best fits his or her application. By practicing this invention, users can create prints that are colorful, lightfast, or some combination of these two. In one embodiment, the invention takes into account the characteristics of the printing medium and determines from that information how to optimize the lightfastness and gamut of an image.

BACKGROUND OF THE INVENTION

The use of inkjet printing systems has grown dramatically in recent years. This growth may be attributed to substantial improvements in print resolution and overall print quality coupled with appreciable reduction in cost. Today's inkjet printers offer acceptable print quality for many commercial, business, and household applications at costs fully an order of magnitude lower than comparable products available just a few years ago. Notwithstanding their recent success, intensive research and development efforts continue toward improving inkjet print quality. A surge in interest in inkjet printing has resulted in the need to produce high quality prints at a reasonable cost. The challenge remains to further improve the print quality and lightfastness of inkjet prints. The use of large format inkjet prints for point-of-purchase displays, posters and signage, requires high-resolution images to be durable, and to retain their color fidelity for as long as possible.

Color inkjet printers typically use three inks of differing hues: cyan, magenta, and yellow. Black is often added as a fourth ink. The particular set of colorants used to make the inks in the inkjet printer is called a "primary dye set." The printer is not, however, limited to printing only the colors contained in the primary dye set. A spectrum of secondary or dilute colors can be generated using different combinations of the primary dye set. An inkjet printer using three primary inks and a black ink typically houses these four inks in chambers within the printer cartridge body. In recent years, there has been an increase in the number of inkjet printing devices employing more than four inks in its primary dye set. In particular, some inkjet printing devices have added light or dilute cyan and light or dilute magenta dyes for a total of six inks that improve grain and tonal continuity of printed images. The addition of more inks to the primary dye set can significantly improve improved image quality. Some Hewlett-Packard inkjet printers, for example, employ two cartridges with three chambers each. In these cartridges, the six chambers contain the following inks: cyan, magenta, yellow, black, dilute cyan, and dilute magenta.

As is well known in the art, a successful ink set for color inkjet printing must be compatible with the inkjet cartridge and the printing system. Some of the required properties for the inkjet ink include: good crusting resistance, good stability, proper viscosity, proper surface tension, thermal stability, little color-to-color and/or color-to-black bleed, rapid dry time, no deleterious reaction with the printhead components, high solubility of the dyes in the vehicle, consumer safety, low strike through on plain or coated papers, high color saturation, good dot gain, and suitable color characteristics. When the foregoing properties, or some subset thereof, are present in a particular ink, skilled artisans may refer to the resultant liquid as a stable ink vehicle.

As is well known in the art, any given perceived color can be described using a color space, such as CIELAB, or Munsell. In the Munsell color space, a given color is defined using three terms, Hue (H), Value (V), and Chroma (C). In the CIELAB color space, a color is also defined using three terms L*, a*, and b*. L* defines the lightness of a color, and it ranges from zero (black) to 100 (white). The terms a* and b*, together, primarily define chroma and hue. The term a* ranges from a negative number (green) to a positive number (red). The term b* ranges from a negative number (blue) to a positive number (yellow). Additional terms such as $h^o$ (hue angle) and C* (chroma) are used to further describe a given color, wherein:

$$h^0 = \tan^{-1} b^*/a^* \qquad \text{Equation 1}$$

$$C^* = (a^{*2} + b^{*2}) \qquad \text{Equation 2}$$

The L*, a*, and b* values, or the Munsell H, V, and C, values can be used to calculate the volume of space that a specific dye set can produce. The larger that volume is, the more color the dye set is capable of producing. This volume, referred to as color gamut (G), can be calculated in the CIELAB color space according to Equation 3.

$$G = \sum_{i=1}^{6} 1/6 * (L^*_{white} - L^*_{black}) * (a^{*2} + b^{*2})_i * \mathrm{Cos}(\Delta h)_i \qquad \text{Equation 3}$$

where i is the following six colors: C, Y, M, R, G, B

In addition to these characteristics, consumers also typically desire printers capable of printing a wide range of colors and of providing images that maintain their color over time. One measure of how well a printed image retains its color over time is lightfastness. Lightfastness is a measure of how colors fade in a printed image when that image is exposed to light. It is advantageous for printer manufacturers to ensure that printouts retain their color quality for as long as possible. Those skilled in the art quantify lightfastness by measuring the percent optical density loss for a particular image. Using various optical density filter deltas, it is possible to monitor color shifts from otherwise monochromatic signals. Data presented using this metric are described in terms of number of years to fail based upon a worst-case percent optical density loss among pure primaries and hue shifts from filter deltas.

A key dilemma in designing inkjet printers is the tradeoff that must be made between simultaneously trying to increase lightfastness and gamut. Dye-based colorants that produce high chroma, and therefore high gamut, trade this brightness for longevity. Brighter dyes simply burn out faster. Conversely, dyes of lower inherent chroma exhibit greater resistance to various fade mechanisms. There is thus a need for a method that would allow a user to create printouts that maximize lightfastness or gamut, or, in the alternative, lie somewhere in the middle of the continuum between maximum lightfastness and maximum gamut.

SUMMARY OF THE INVENTION

The present invention is directed toward a method of that provides a user with the ability to choose the combination of dye species that best fits his or her application. Users can create prints that are colorful, lightfast, or some combination of these two. In one embodiment, the invention takes into account the characteristics of the printing medium and determines from that information how to optimize the lightfastness and gamut of an image. Lightfastness and gamut tend to relate inversely, in that the better the lightfastness, the worse the gamut and vice versa. The lightfastness and gamut of an image can be altered by changing the colorants used to print the image. High-chroma inks produce images with high gamut values. Conversely, images printed with low-chroma inks have increased lightfastness. An embodiment of this invention uses the characteristics of the print medium, upon which the image will be printed, to optimize the tradeoffs that exist between lightfastness and gamut. In this embodiment the relative amount of high- and low-chroma ink varies depending upon the characteristics of the print medium.

BRIEF DESCRIPTION OF THE DRAWING

The invention is described with reference to the several figures of the drawing, in which.

DETAILED DESCRIPTION

Figure 1:
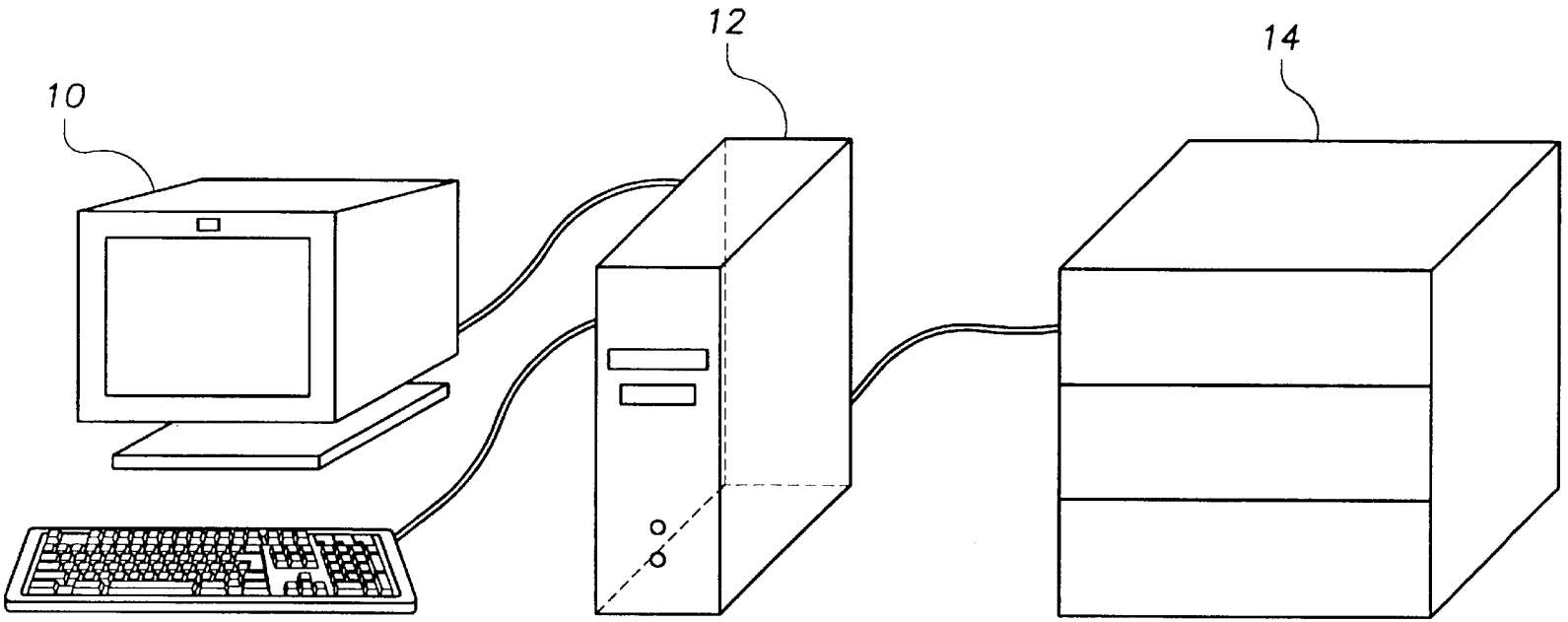
FIG. 1 is a diagram of a typical configuration where an inkjet printer may be used to print an image.

The present invention is directed toward a method for optimizing the lightfastness and gamut of images printed with inkjet printers. A typical configuration utilizing an inkjet printer is depicted in FIG. 1. Referring to FIG. 1, an image-viewing device 10 is coupled to an image-generating device 12, which is itself coupled to an inkjet printer 14. The image-viewing device could be a computer monitor; and the image-generating device could be a computer with appropriate imaging software. The inkjet printer 14 comprises a printer cartridge 20, depicted in FIG. 2.

Figure 2:
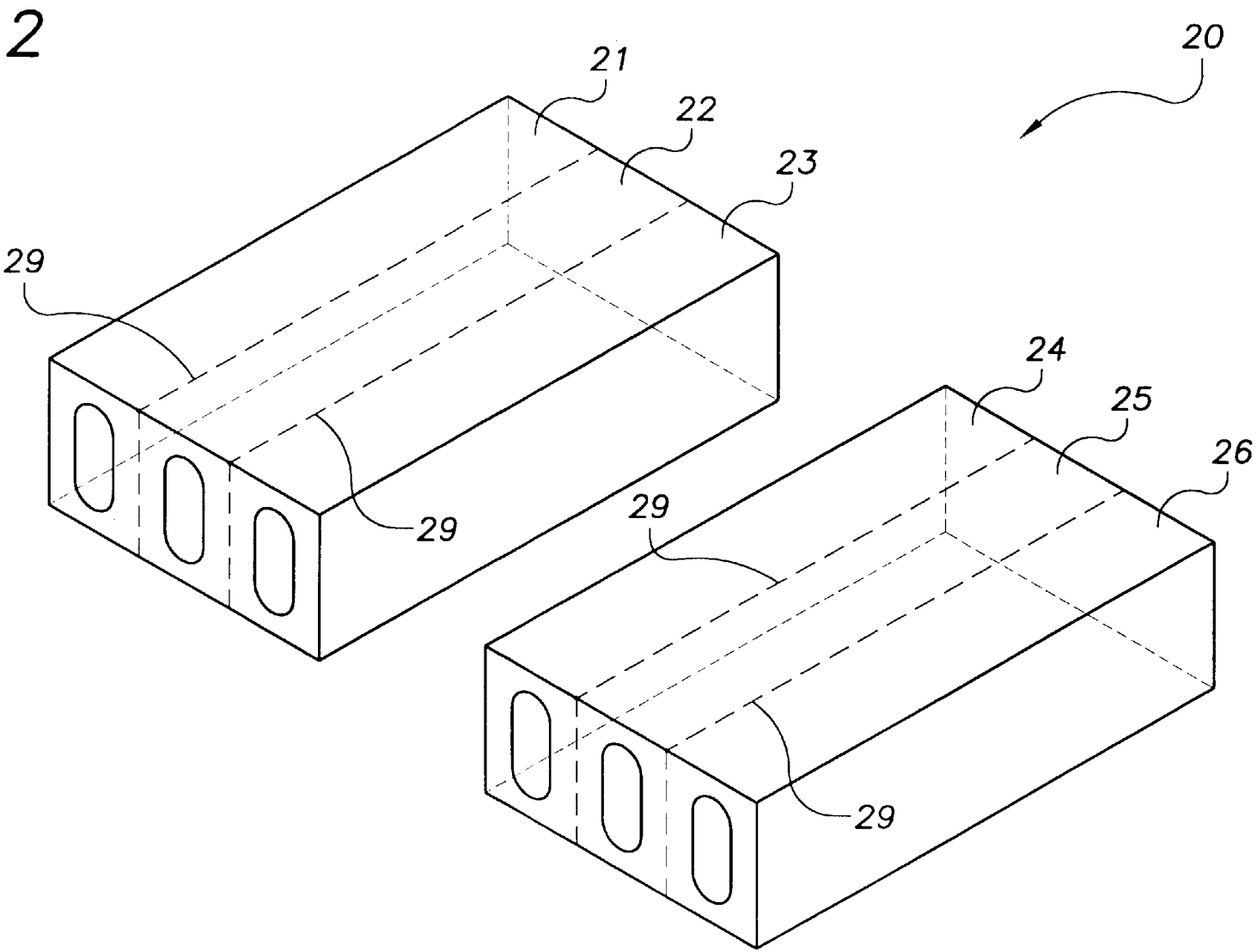
FIG. 2 is a perspective view of a print cartridge scheme used in an embodiment of the present invention.

Many inkjet printers presently operative utilize print cartridges similar to that depicted in FIG. 2, employing what is known in the art as a dual dye-load scheme. As can be seen from FIG. 2, the printer cartridges 20 have two tri-chambered reservoirs. Two exemplary cartridges that could be used in a dual dye-load scheme print are cartridge model Numbers HP c6657a and HP c6658a, available from Hewlett-Packard Company of Palo Alto, Calif. The reservoirs of HP c6657a contain cyan, magenta, and yellow ink, while those of HP c6658a contain dilute cyan, dilute magenta, and black ink. The tests results presented below were obtained using a modified dual dye-load scheme. The choice of printer cartridge scheme depicted in FIG. 2 is exemplary, however, and not intended to limit the scope of this invention. The invention disclosed herein would operate equivalently with a single printer, cartridge of six or more reservoirs.

As can be seen from FIG. 2, the two tri-chambered print cartridges 20 have a total of six ink reservoirs, 21, 22, 23, 24, 25, and 26. The ink reservoirs are divided by partitions 29 within the print cartridges 20. An exemplary dual dye-load scheme may be constructed such that chamber 21 contains high dye-load cyan ink. Chamber 22 could contain high dye-load magenta ink. Chamber 23 could contain standard yellow ink. Chamber 24 could contain low dye-load cyan ink. Chamber 25 could contain low dye-load magenta ink; and chamber 26 could contain black ink. In a dual dye-load scheme, the low dye-load magenta, low dye-load cyan and yellow are typically used in areas of low ink saturation as a means of reducing the graininess and improving tonal continuity in the printed image.

In one embodiment of the present invention, the dual dye-load scheme described above with reference to FIG. 2 could be supplanted as follows. Chambers 21 and 22 could contain full dye load, high-chroma inks, while chambers 24 and 25 could contain high dye-load, low-chroma inks. In terms of the actual colors within the chambers of this embodiment, chambers 21 and 24 could be cyan and chambers 22 and 25 could be magenta. Chambers 23 and 26 would remain unchanged from the dual dye-load scheme described above as a typical configuration. That is, in this embodiment, chamber 23 could contain yellow ink similar to that used in the aforementioned HP cartridges, while chamber 26 could contain black ink. The black ink could comprise a dye based black ink or a composite black ink. The selection of chamber locations for each ink could be varied without affecting the performance of the print cartridge 20.

Inks that have high-chroma values are typically characterized by a low lightfastness, i.e., they fade quickly when exposed to light. As would be expected in light of the tradeoffs that exist between gamut and lightfastness, high-chroma inks have high gamut values. Low-chroma inks, on the other hand, typically have high lightfastness values and low gamut values. As was discussed earlier, functional inks must possess additional properties in order to be implemented in an inkjet printer. Some of these characteristics include good crusting resistance, good stability, proper viscosity, proper surface tension, thermal stability, little color-to-color bleed, rapid dry time, no deleterious reaction with the printhead components, high solubility of the dyes in the vehicle, consumer safety, low strike through on plain or coated papers, high color saturation, good dot gain, and suitable color characteristics. Achieving these properties can be accomplished by including additives in the ink composition.

Figure 3:
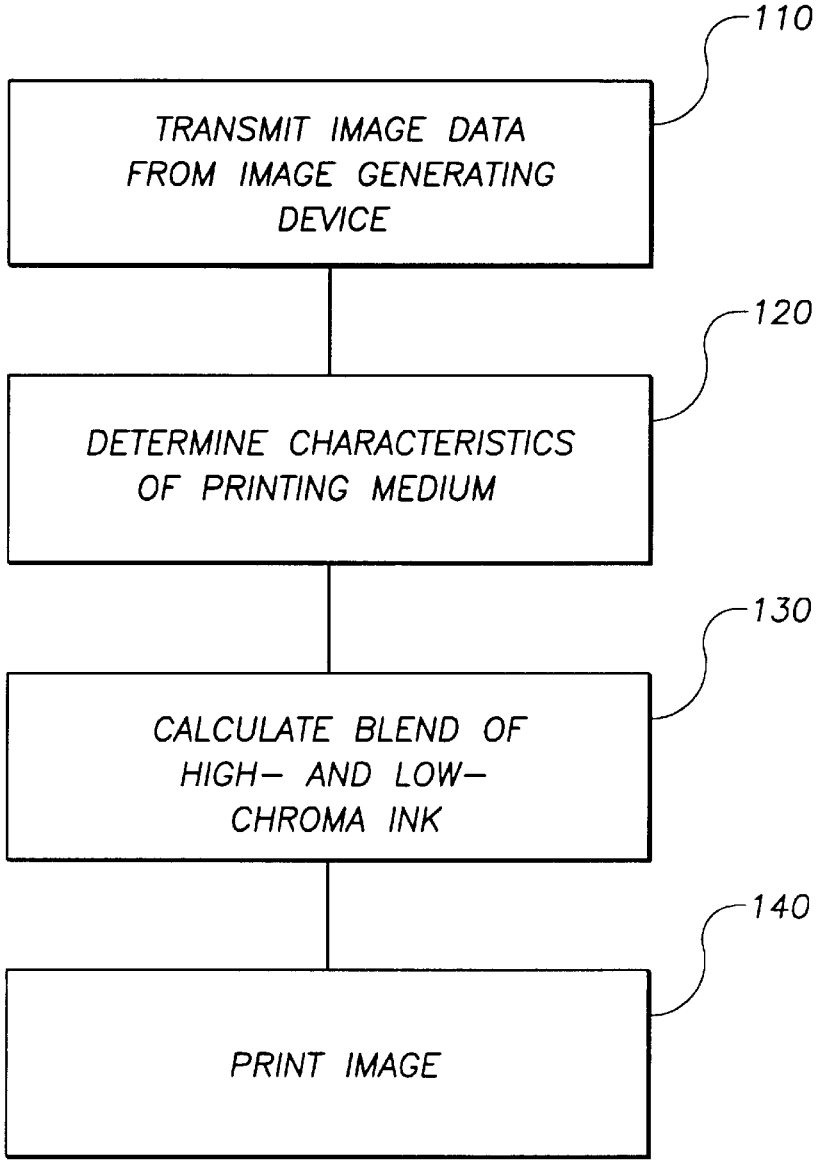
FIG. 3 is a flow chart of an embodiment used to optimize lightfastness and gamut.

The invention disclosed herein is not directed to a specific set of inks. In fact, one advantage of the present invention is that it can be implemented with a variety of inks. In light of this versatility, a discussion of specific additives is beyond the scope of this disclosure. For examples of buffers, surfactants, biocides, humectants, and the like that can be used to increase performance of an ink set see U.S. Pat. No. 5,772,742 to P. Wang, dated Jun. 30, 1998, entitled "Dye Set for Improved Color Quality for Ink-Jet Printers;" see also U.S. Pat. No. 5,851,273 to Morris et al., dated Dec. 22, 1998, entitled "Dye Set for Improved Ink-Jet Print Quality;" U.S. Pat. No. 5,851,274 to Lin, dated Dec. 22, 1998, entitled "Ink Jet Ink Compositions and Processes for High Resolution and High Speed Printing." The steps of a method for optimizing the lightfastness and gamut of an output image from an inkjet printer are depicted in FIG. 3. According to this embodiment, image data could be transmitted 110 from an image-generating device, such as that shown by reference number 12 in FIG. 1, to an inkjet printer 14. The image data transmission could be initiated by a computer user desiring to print an image. Similarly, a software program could be operational such that an image generating device 12 is queued to print images by the software program. The inkjet printer 14 in this embodiment could be configured with a combination of high- and low-chroma inks as described above with reference to FIG. 2. Additional embodiments could utilize this method with different combinations of ink than those described with reference to FIG. 2. Similarly, additional ink chambers could be added in additional embodiments of the inventive method.

With reference to FIG. 3, after the image has been transmitted to the inkjet printer 14 in this embodiment, the next step comprises determining 120 the characteristics of the printing medium. One characteristic that could be used is the lightfastness of the printing medium. If, for example, the print substrate was photo paper with a swellable, less lightfast coating, the tradeoffs between lightfastness and gamut could be reduced by printing an image using a blend of ink that contained a preponderance of high-chroma ink. In this way, the resultant image would not exceed the lightfastness capability of the photo paper, while simultaneously increasing the gamut of the printed image. If, on the other hand, the printing medium was plain paper, which is characterized by a good lightfastness value, the ink blend used could have a preponderance of low-chroma ink, thereby maximizing the lightfastness of the output.

The determination of a characteristic of the print medium could be accomplished in a variety of ways. In one embodiment a default setting could be used. This default could be an average print medium, such as plain or photo paper, for example. In an additional embodiment, the user could supply information to the printer via a printer driver's graphical user interface or printer front panel whereby the user could provide information that would be used by the printer to determine the amount of high- or low-chroma ink for the printer to use when printing 140 the image on the printing medium. This information could be obtained via a menu selection device whereby the user is allowed to choose a medium from a list of available print media. The list of media could include plain paper, coated papers, transparencies, photo papers, and the like. Once the user makes her choice, the printer driver interface could consult a look-up table or similar storage medium in a host computer or in the printing device that could correlate the printing medium chosen by the user with a percentage of high- and low-chroma ink to be used to print the image. This correlation would be performed in a way that would take into account the lightfast and imaging characteristics of the printing medium and tailor the ink blend to those characteristics. For example, if the user selected a transparency as the printing medium, the blend of ink used to print on the transparency could comprise a preponderance of high-chroma ink because transparencies need to project brightly, but generally require reduced lightfastness. Alternatively, if the user chose photo paper, the dye blend would comprise a preponderance of low-chroma ink, thereby increasing the longevity of the relatively high gamut photo paper.

In an additional embodiment, a media detection algorithm could be utilized as a means of determining what type of medium was being used as a printing substrate. An exemplary media detection algorithm was disclosed in U.S. Pat. No. 6,036,298 entitled "Monochromatic Optical Sensing System for Inkjet Printing," the contents of which are hereby incorporated by reference. In this embodiment, the step depicted by reference numeral 120 in FIG. 3 would be supplanted by the media detection algorithm. As was the case in the embodiment above, once the characteristics of the printing medium have been determined the method of the present embodiment could use this information to determine the blend of high- and low-chroma inks to use for printing the image.

In terms of actually calculating 130 the specific blend of high- and low-chroma inks to use once the characteristics of the print medium have been determined 120, this calculation could be made in a variety of ways. In one embodiment, there could be a default setting whereby a predetermined amount of high- and low-chroma ink could be used to print the image. The default setting could be tailored to printing on plain paper, using the characteristics of plain paper described above. If a user desired to change the default printing medium, a lookup table could be consulted wherein the table could contain percentage blends of high- and low-chroma inks correlated with the type of print medium to be used for the printout.

Figure 4:
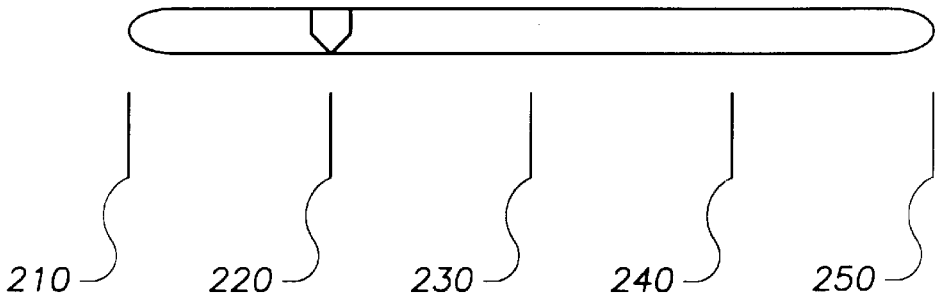
FIG. 4 is a perspective view of a graphical user interface used in one embodiment to manually alter the blend of high- and low-chroma ink used to generate an image.

Alternatively, a graphical user interface could include a slider as shown in FIG. 4. In this way, a user could override the characteristics of the printing medium and manually alter the blend of high- and low-chroma ink used to print an image. If for example, the user desired to print an image using only high-chroma ink, she could position the slider at reference numeral 210 in FIG. 4. The graphical user interface could transmit this user's preference for high-chroma ink to the inkjet printer, which would in turn print an image using solely high-chroma ink. If, on the other hand, a user desired to print an image using only low-chroma ink, he could position the slider of FIG. 4 at 250. In this way, the user would similarly obtain an image printed solely with low-chroma ink, irrespective of the characteristics of the printing medium. Any intermediate adjustment of the ratio of high- to low-chroma ink could of course also be used.

The slider can be combined with a media selection tool. For example, the interface may use position 230 as the default, which can be varied by the user, for both transparencies and photo paper, although a higher proportion of high-chroma ink would be used for the transparency as compared to the photo paper. In order to test the methods disclosed herein, I formulated inks and generated the following gamut and fade data. These high- and low-chroma inks, were based upon HP's 78A ink formulation. In my tests, I placed the inks in an inkjet cartridges similar to those depicted in FIG. 2. Using a printer very similar to HP's 900 series with HP Premium Plus Photo Paper, glossy media, I measured print diagnostics for gamut and fade. The colorants used and the concentration, given in a percent weight value, are listed in Table 1. Table 1 contains separate columns for the high- and low-chroma inks. In addition, Table 1 sets forth gamut and fade data for the inks I used in my tests.

In practice, additional materials would be a part of the ink formulation. As was discussed above, those skilled in the art will appreciate that most commercial inkjet inks include one or more of, for example, water, a humectant, a surfactant, and a biocide. It should be noted that the methods disclosed herein are versatile and intended to allow optimization of lightfastness and gamut irrespective of the composition of the ink set used to practice this method.

In order to obtain gamut data, the L*, a*, and b* coordinates of KCMYRBW squares for each ink set were measured. These measurements were made using an XRite 938 Spectrodensitometer (2 degree observer, D65 illuminant). Once these coordinates were obtained, the inventor placed them into a proprietary spreadsheet that calculates gamut volume. The gamut volume calculations were generated by using eight sets of 3D points to form a dodecahedron. The dodecahedron was then used to calculate a gamut volume. Table 1 contains information related to the inks used to perform the tests.

TABLE 1

Information Concerning the Inks Used to Perform Tests

| Test data | High-Chroma Inks | Low-Chroma Inks |
|---|---|---|
| Cyan colorant/concentration (wt %) | AB9/8.2% | DB199/18.4% |
| Magenta colorant/concentration (wt %) | AR52/7.3% | RR23/32.3% |
| Yellow colorant/concentration (wt %) | AY23/17% | DY132/14.1% |
| Gamut (KCMYRGBW colors) | 402263 | 240323 |
| Cyan Fade (% OD Loss) | 97.0% | 3.0% |
| Magenta Fade (% OD Loss) | 97.0% | 3.0% |
| Yellow Fade (% OD Loss) | 95.0% | 2.0% |
| Pure Cyan Fade (years to fail) | 0.1 | 66.0 |
| Pure Magenta Fade (years to fail) | 0.3 | 51.0 |

Image quality depends in part upon the drop volume of the particular printer being used. I used a printer with a drop volume of 5 ng. If one were to practice this invention with a printer with a lower drop volume, he would expect to see images with even better grain and contone properties. As drop volume capabilities of printers decrease, the image quality of printouts generated using this invention will become even better.

Table 2a contains color coordinate data for the inks I tested. Table 2b presents the gamut data for these inks, generated using the dodecahedron technique described above. Of note, the ink limit value of the composite black ink was 154 ng/300$^{th}$ in.$^2$. One skilled in the art is aware that it takes less ink to achieve maximum chroma for primary and secondary colors than it does for composite black. As such, typical ink limits for primary colors are 80 ng/300$^{th}$ in.$^2$, while ink limits for secondary colors are typically 120 ng/300$^{th}$ in.$^2$.

TABLE 2a

Color Coordinate Data

| Sample | Colors | L* | a* | b* | Chroma | h(°) |
|---|---|---|---|---|---|---|
| HP Premium Plus | black | 23.7 | −20.02 | −4.26 | 20.4682 | 192.0 |
| Photo Paper, glossy | cyan | 68.27 | −37.96 | −38.42 | 54.0098 | 225.3 |
| High-chroma | magenta | 56.8 | 77.88 | −45.93 | 90.4149 | 329.5 |
| ink | yellow | 89.26 | −5.57 | 96.39 | 96.5508 | 93.3 |
| | red | 59.21 | 74.56 | 56.03 | 93.2660 | 36.9 |
| | green | 61.58 | −66 | 51.14 | 83.4943 | 142.2 |
| | blue | 49.06 | −1.29 | −63.3 | 63.3131 | 268.8 |
| | white | 95.5 | 0.23 | −3.53 | 3.5375 | 273.7 |
| HP Premium Plus | black | 9.44 | 15.65 | −24.23 | 28.8447 | 302.9 |
| Photo Paper, glossy | cyan | 63.05 | −28.07 | −45.19 | 53.1983 | 238.1 |
| Low-chroma | magenta | 41.23 | 62.49 | −5.45 | 62.7272 | 355.0 |
| ink | yellow | 91.91 | −12.29 | 61.03 | 62.2552 | 101.4 |
| | red | 47.23 | 59.18 | 33.36 | 67.9350 | 29.4 |
| | green | 61.23 | −64.66 | 14.49 | 66.2637 | 167.4 |
| | blue | 34.29 | 11.98 | −54.33 | 55.6351 | 282.4 |
| | white | 95.89 | 0.2 | −3.39 | 3.3959 | 273.4 |

TABLE 2b

Gamut Calculations

| Sample | L* | a* | b* | Tetra-hedron | C Lab Vol. | Estd Mnsl Vol. |
|---|---|---|---|---|---|---|
| HP Premium Plus | 95.5 | 0.23 | −3.53 | | | |
| Photo Paper, | 23.7 | −20.02 | −4.26 | Vyrwk | 104076.7 | |

TABLE 2b-continued

Gamut Calculations

| Sample | L* | a* | b* | Tetra-hedron | C Lab Vol. | Estd Mnsl Vol. |
|---|---|---|---|---|---|---|
| glossy | 56.8 | 77.88 | −45.93 | Vrmwk | 106023.1 | |
| High-chroma | 89.26 | −5.57 | 96.39 | Vmbwk | 57025.5 | |
| ink | 59.21 | 74.56 | 56.03 | Vbcwk | 26445.5 | |
| | 61.58 | −66 | 51.14 | Vcgwk | 43556.5 | |
| | 49.06 | −1.29 | −63.3 | Vgywk | 65136.2 | |
| | 68.27 | −37.96 | −38.42 | Gamut Vol | 402263 | 1549 |
| HP Premium Plus | 95.89 | 0.2 | −3.39 | | | |
| Photo Paper, | 9.44 | 15.65 | −24.23 | Vyrwk | 56589.0 | |
| glossy | 41.23 | 62.49 | −5.45 | Vrmwk | 28633.2 | |
| Low-chroma | 91.91 | −12.29 | 61.03 | Vmbwk | 27434.8 | |
| ink | 47.23 | 59.18 | 33.36 | Vbcwk | 18128.9 | |
| | 61.23 | −64.66 | 14.49 | Vcgwk | 47593.8 | |
| | 34.29 | 11.98 | −54.33 | Vgywk | 61943.6 | |
| | 63.05 | −28.07 | −45.19 | Gamut Vol | 240323 | 967 |

In order to measure the fade characteristics of the images generated as part of this experiment, I performed an initial optical density measurement of KMCY color ramps at time zero. I then placed these fade diagnostics into an HP Fadeometer, which employs cool white fluorescent bulbs, at approximately 60 kLux. Those skilled in the art will recognize that determining years to failure in the context of fade data can vary depending upon the lux/day of fade one assumes when making the calculations. In the data presented below, a 450 lux/day fade value was assumed. Using this illuminance per day value, I generated fade data for 2.5 years and 5 years. These data are presented below in Table 3.

TABLE 3

Five Years Fade Data

| Fade experiment setup/criteria | | |
|---|---|---|
| Number of Simulated Years | 5 | (0, 2.5, and 5 simulated years) |
| Number of temporal data points | 3 | |
| Initial Density | 0.5 | |
| Neutral Δhue (R-G) failure threshold | 12% | |
| Neutral Δhue (R-B) failure threshold | 18% | |
| Neutral Δhue (G-B) failure threshold | 18% | |
| Pure Cyan failure threshold | 30% | |
| Pure Magenta failure threshold | 25% | |
| Pure Yellow failure threshold | 35% | |

| Sample | Mode | % Loss | Acceptable? | Interpolated/ Extr apolated years to fail |
|---|---|---|---|---|
| High Chroma Inks | Neutral Δhue (R-G) | 5% | Yes | 12.6 |
| HP Premium Plus Photo Paper, glossy | Neutral Δhue (R-B) | 2% | Yes | 51.3 |
| | Neutral Δhue (G-B) | 3% | Yes | 29.9 |
| | Pure Cyan | 97% | No | 0.1 |
| | Pure Magenta | 97% | No | 0.3 |
| | Pure Yellow | 95% | No | 0.4 |
| Low Chroma Inks | Neutral Δhue (R-G) | 2% | Yes | 24.8 |

TABLE 3-continued

| Five Years Fade Data | | | | |
|---|---|---|---|---|
| HP Premium Plus Photo Paper, glossy | Neutral Δhue (R-B) | 4% | Yes | 20.3 |
| | Neutral Δhue (G-B) | 7% | Yes | 13.1 |
| | Pure Cyan | 3% | Yes | 66.4 |
| | Pure Magenta | 3% | Yes | 51.7 |
| | Pure Yellow | 2% | Yes | 116.7 |

As can be seen from these data, using a blend of high- and low-chroma inks tailored to the characteristics of the printing medium is an effective way to optimize lightfastness and gamut. While these results show fairly large gamut volumes and relatively large numbers of years to fade, it should be noted that gamut volume and years to fade will vary depending upon such variables as the ink compositions used, print-medium, printer, and the like.

Other embodiments of the invention will be apparent to those skilled in the art from a consideration of the specification or practice of the invention disclosed herein. It is intended that the specification and examples be considered as exemplary only, with the true scope and spirit of the invention being indicated by the following claims.

What is claimed is:

1. A method of optimizing lightfastness and gamut of an output of an inkjet printer comprising the steps of:

transmitting image data from an image generating device to the inkjet printer wherein the inkjet printer is configured with an ink storage device comprising a first and second ink, each in a stable ink vehicle, the first ink having a higher chroma value than the second ink;

calculating, either before or after the transmitting step, a relative amount of first and second ink to use for printing the image data, by using a characteristic of a printing medium to determine the relative amount of first and second inks to use for printing the image data; and printing the image data on the printing medium.

2. The method of claim 2, wherein the characteristic of the printing medium is the lightfastness of the inks when printed on the printing medium.

3. The method if claim 1, wherein the characteristic of the printing medium is the gamut volume of the inks when printed on the printing medium.

4. The method of claim 2, further comprising:

storing default settings in a storage medium, said default setting comprising characteristics of printing media; and, using a default setting to calculate a relative amount of first and second ink to use for printing the image.

5. The method of claim 4, further comprising allowing a user to select which default setting to use.

6. The method of claim 4, further comprising providing user input via a graphical user interface wherein the graphical user interface allows the user to vary the relative amount of first and second ink used to print the image data.

7. The method of claim 1, further comprising using a medium detection algorithm to determine the characteristics of the printing medium.

8. A method of allowing a user to optimize lightfastness and gamut of an output of an inkjet printer comprising the step of presenting a user with a graphical user interface, wherein the graphical user interface allows the user to vary a relative amount of a first and second ink used to print an image.

9. The method of claim 8, wherein the graphical user interface is selected from the group consisting of a slider, a dialog box, and a list of printing media upon which the output will be printed.

* * * * *